United States Patent [19]

Leinberger et al.

[11] 4,320,874

[45] Mar. 23, 1982

[54] BURNER HEAD OF A FUEL-OXYGEN BURNER

[75] Inventors: Klaus Leinberger, Willich; Heinz Golke, Ratingen, both of Fed. Rep. of Germany

[73] Assignee: Messer Griesheim GmbH, Frankfurt am Main, Fed. Rep. of Germany

[21] Appl. No.: 142,869

[22] Filed: Apr. 24, 1980

[30] Foreign Application Priority Data

Apr. 25, 1979 [DE] Fed. Rep. of Germany ..... 2916635

[51] Int. Cl.[3] ..... B05B 7/10

[52] U.S. Cl. ..... 239/403; 239/424; 431/182

[58] Field of Search ..... 239/403, 405, 406, 400, 239/422, 424; 431/182, 183, 185, 354

[56] References Cited

U.S. PATENT DOCUMENTS 3,897,007 7/1975 Roy ..... 239/403

4,171,199 10/1979 Henriques ..... 239/424.5 X

*Primary Examiner*—Robert B. Reeves

*Assistant Examiner*—Gene A. Church

*Attorney, Agent, or Firm*—Connolly and Hutz

[57] ABSTRACT

A burner head for a fuel-oxygen burner includes a first chamber connected at one end with the oxygen intake and at the other end with a second chamber by means of a nozzle and includes a pipe located in the fuel intake and opening into the first chamber.

11 Claims, 3 Drawing Figures

BURNER HEAD OF A FUEL-OXYGEN BURNER

BACKGROUND OF INVENTION

The present invention relates to a burner head for a fuel-oxygen burner, generally consisting of a housing, on which one side is provided with intakes for fuel and oxygen, while the other side has an opening for the outgoing burner flame.

Fuel-oxygen burners are utilized where very high temperatures are required but which can not be obtained with the common fuel-air burners. Such high temperatures are required, for instance, in the melting off of slag in melting furnaces. Further, such burners are used in scrap melting. Such burners are part of the state of the art, as exemplified by German Preliminary Published application DE-OS No. 27 13 570.

SUMMARY OF INVENTION

An object of the invention is to provide a fuel-oxygen burner by means of which a higher heat output can be obtained, and thereby also obtain improved economy in conjunction with long serviceable life.

To achieve this object, a burner head of a fuel-oxygen burner is provided in accordance with the invention, with the above capabilities and is characterized by the following:

a. the burner head has a first chamber which is connected with the oxygen intake;

b. this first chamber is connected with the second chamber via a nozzle; and c. a fuel intake pipe also opens into this first chamber.

In the preferred practice of the invention, the two chambers are separated by means of a dividing wall and both the nozzle and the fuel intake pipe extend through this dividing wall.

It is an additional advantage to have the nozzle end extending into the second chamber in an angled manner.

It is also advantageous for the pipe to be placed centrally in the fuel intake and be connected with the first chamber via an opening in the fuel intake enclosure.

In the burner according to the invention, the fuel is attracted through the oxygen according to the injector principle, so that, advantageously, no special transportation device (pump) is required if liquid fuel is used. By means of the interior and exterior admission of the fuel via the oxygen, a very homogeneous oxygen-fuel mixture is formed, with correspondingly high flame temperature, giving the burner a very high performance of e.g. approximately 350,000 kcal./h. By angling the nozzle provided in the separating wall, the oxygen flow exiting from it is put into rotation in an advantageous manner, whereby this rotational flow first follows the inside of the housing wall, thus causing a cooling effect. Thus, a separate water cooling of the burner is no longer necessary, which is an additional advantage.

THE DRAWINGS

DETAILED DESCRIPTION

Fuel-oxygen burners are used in the industry for scrap melting, for melting off slag in melting furnaces, etc. The invention improves the economy of these known burners in such a manner that a higher flame temperature is obtained by means of improved mixing of fuel and oxygen, whereby the result is improved efficiency of the burner.

Figure 1:
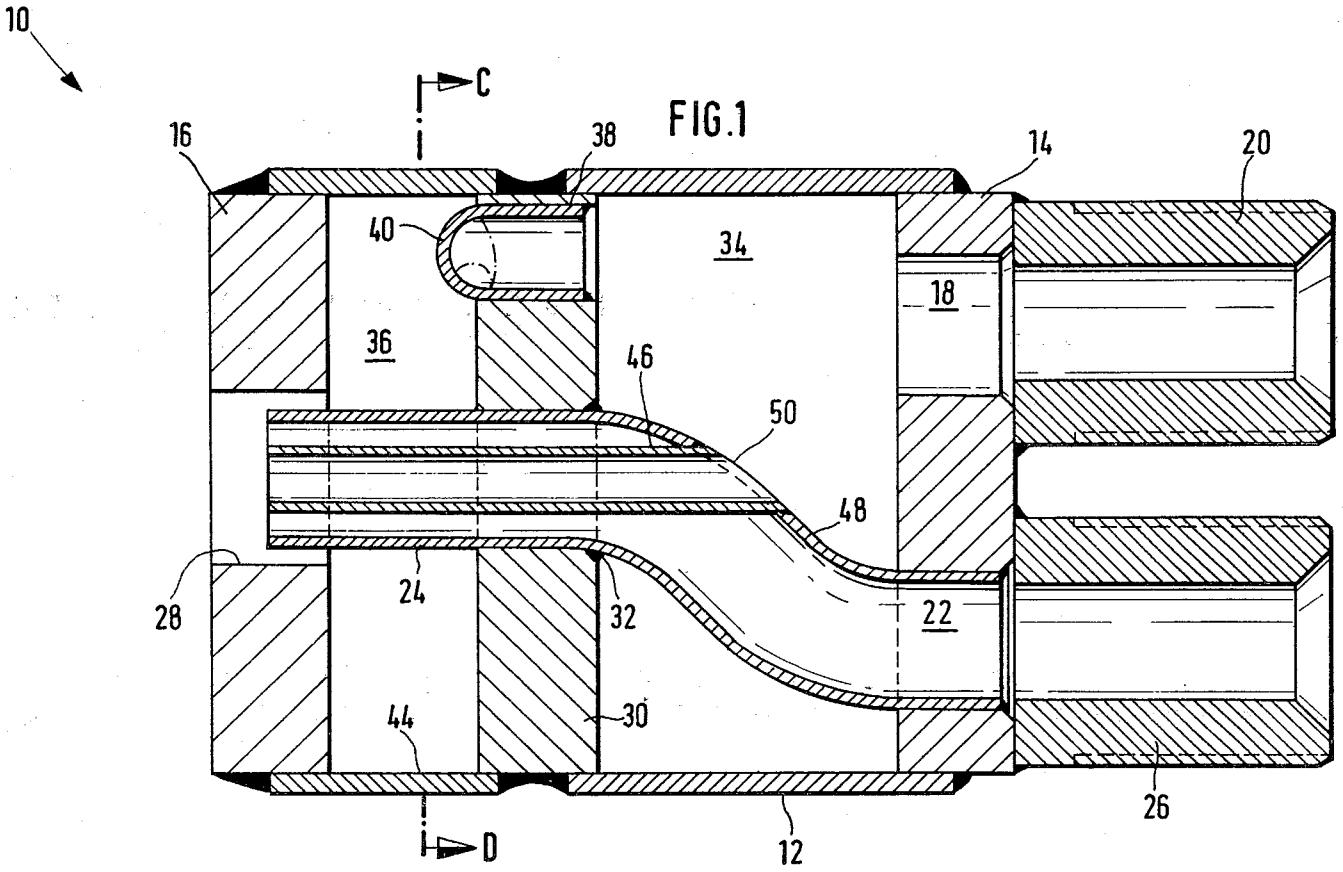
FIG. 1 is a cross-sectional view of a burner head for a fuel-oxygen burner, according to the invention.

FIG. 1 illustrates a cross section of a burner head 10 according to the invention. This burner head has a cylindrical housing 12, both ends of which are covered by end plates 14, 16. Via a hole drilled 18 in the end plate 14, an oxygen intake 20 is connected with the interior space of the housing 12. An additional perforation 22 of the end plate 14 serves to accommodate one end of a pipe-line or passageway 24 designed in an S-shape, as shown in FIG. 1, and forming the interior extension of the fuel supply line 26.

The other end of the S-shaped pipe-line 24 extends to a centrally located opening 28 in the left end plate 16 of the burner head 10. In the location of the centric portion of the pipe-line 24, it penetrates a dividing wall 30 in the interior of the housing 12. In order to stabilize the pipe-line 24, this line is welded to the dividing wall 30 in a gas-tight manner which is illustrated by means of the welding seam 32.

The interior of the housing 12 is divided by means of the dividing wall 30 into a first chamber 34 and a second chamber 36. A peripherally located penetration 38 of the dividing wall 30 serves to accommodate a nozzle 40, by means of which a connection is created between the two chambers 34, 36.

Figure 2:
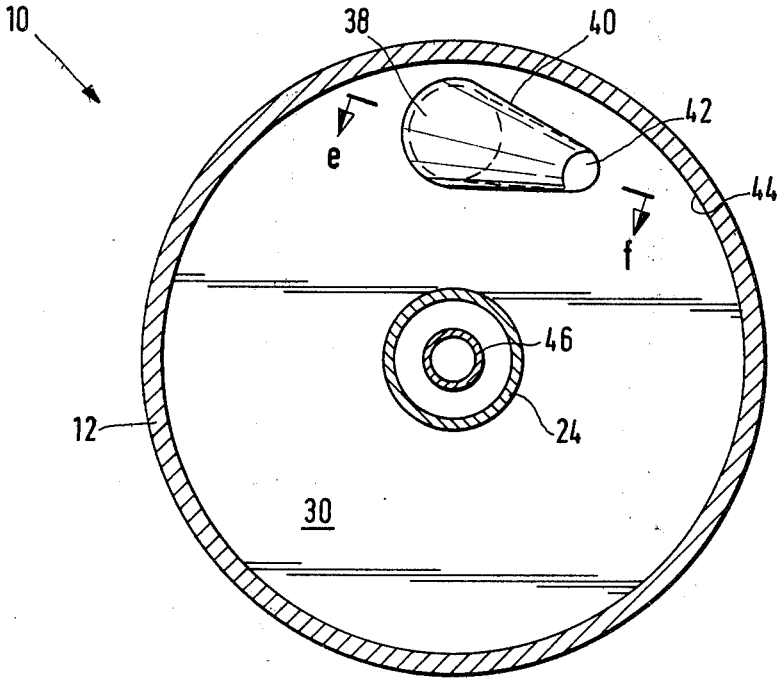
FIG. 2 is a cross section taken along the line C–D FIG. 1.
Figure 3:
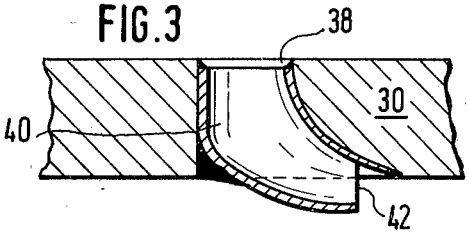
FIG. 3 is a cross section taken along the line e–f in FIG. 2.

As can be seen specifically from FIGS. 2 and 3, that end of the nozzle 40 which opens into the second chamber 36 is angled tangentially, so that the oxygen coming from the first chamber 34 flows in in the form of a jet rotating around the pipe-line 24 into the second chamber 36. By means of the basically parallel arrangement of the angled nozzle opening 42 in relation to the inside wall 44 of the housing 12, the exiting oxygen jet first follows this interior wall 44, before it arrives to the area of the opening 28 in the end plate 16 (left side in FIG. 1).

As furthermore shown in FIG. 1, a pipe 46 is centrally located in the pipe-line 24 ending flush with the pipe-line 24 in the area of the opening 28. In the curved portion of the pipe-line 24 located in the first chamber 34, an opening 50 is provided in its wall 48, in the vicinity of which the other end of the pipe 46 is attached by means of welding/soldering, as can be seen from FIG. 1.

During the operation of the burner, the oxygen flows from the oxygen intake 20, first into the first chamber 34, where it divides into two partial flows, of which one enters the pipe 46 via the opening 50, while the other partial flow enters the second chamber 36 via the nozzle 40 in the form of a tangential jet. The second oxygen jet which rotates in the second chamber 36 for cooling purposes, then joins the first oxygen flow, coming from the pipe-line 46, and leaves the burner head via the opening 28. Due to this injector effect of the oxygen, the (liquid or gaseous) fuel supplied from the fuel intake 26 is sucked out from the pipe-line 24. Due to the centric arrangement of an oxygen jet, which is encased by fuel, which is in turn surrounded by a second oxygen layer (situation in the area of the opening 28), there occurs a very intensive mixing of the fuel with the oxygen, so that the result of this optimal mixing process, a very high flame temperature is obtained, and, consequently, the heat effect of the burner is significantly improved. In spite of this increased flame temperature, it is not necessary to provide a special cooling (e.g. with water) of the burner, since the oxygen in the chambers 34, 36 provides a sufficient cooling effect on the burner head.

Due to the given diameters of nozzle 40 and pipe 46, corresponding quantitative rations of oxygen and fuel are provided, so that a specific flame configuration is obtained. It is self-evident and within the framework of the invention that the flame configuration and the performance of the burner can be favorably varied as needed by means of changing the oxygen flow in the nozzle 40 and/or pipe 46. This can be done either by changing the diameters of nozzle 40 and/or pipe 46, or it is also possible to insert screens or chokes in the nozzle 40 and/or pipe 46, thus changing the diameter as needed. Separate supplies of oxygen to the nozzle 40 and to the pipe 46 via separate pipe-lines which may be provided with regulator valves or similar devices, could also be applied and would be within the framework of the invention.

What is claimed is:

1. In a fuel-oxygen burner head including a housing having at one side thereof a fuel intake passage and an oxygen intake passage and having at its opposite side thereof a discharge opening for discharging a torch flame created from a mixture of the fuel and oxygen, the improvement being a first chamber in said housing in flow communication with said oxygen intake passage, a second chamber downstream from said first chamber in flow communication with said discharge opening, a fuel passageway connected in flow communication with said fuel intake passage and extending through said first chamber and into said second chamber for feeding fuel to said discharge opening, means in said first chamber for dividing the oxygen flowing therein into two streams for cooling said burner and permitting the oxygen to mix with the fuel at said discharge opening, said means in said first chamber including a nozzle in flow communication with said second chamber for feeding one oxygen stream thereto to cool said burner, and said means in said first chamber further including a pipe in said fuel passageway communicating at its upstream end with said first chamber and terminating at its downstream end in the general area of said passageway whereby the other stream of oxygen may flow therethrough.

2. Burner head according to claim 1, characterized thereby that said first and said second chambers are separated by a dividing wall, and said nozzle and said fuel passageway extending through said dividing wall.

3. Burner head according to claim 2, characterized thereby that 1 end of said nozzle which extends into said second chamber is angled.

4. Burner head according to claim 3, characterized thereby that said pipe is located in the center of said fuel passageway and connected with said first chamber by means of an opening in the wall of said fuel intake passage.

5. Burner head according to claim 4, characterized thereby that the diameter of said nozzle is variable.

6. Burner head according to claim 5, characterized thereby that the diameter of said pipe is variable.

7. Burner head according to claim 2, characterized thereby that said pipe is located in the center of said fuel passageway and connected with said first chamber by means of an opening in the wall of said fuel intake passage.

8. Burner head according to claim 1, characterized thereby that end of said nozzle which extends into said second chamber is angled.

9. Burner head according to claim 1, characterized thereby that the diameter of said nozzle is variable.

10. Burner head according to claim 1, characterized thereby that the diameter of said pipe is variable.

11. Burner head according to claim 1, characterized in that said pipe terminates coterminous and concentric with said fuel passageway whereby the stream of oxygen from said pipe is surrounded by the fuel which in turn is surrounded by the oxygen from the other stream.

* * * * *